US010197246B2

(12) United States Patent
Hsu

(10) Patent No.: US 10,197,246 B2
(45) Date of Patent: Feb. 5, 2019

(54) ZOOM LAMP

(71) Applicant: DONGGUAN JIA SHENG LIGHTING TECHNOLOGY COMPANY LIMITED, Dongguan, Guangdong (CN)

(72) Inventor: Shui-Sheng Hsu, Dongguan (CN)

(73) Assignee: DONGGUAN JIA SHENG LIGHTING TECHNOLOGY COMPANY LIMITED, Dongguan, Guangdong (CN)

( * ) Notice: Subject to any disclaimer, the term of this patent is extended or adjusted under 35 U.S.C. 154(b) by 161 days.

(21) Appl. No.: 15/363,566

(22) Filed: Nov. 29, 2016

(65) Prior Publication Data

US 2017/0363272 A1 Dec. 21, 2017

(30) Foreign Application Priority Data

Jun. 21, 2016 (CN) ..... 2016 1 0466576
Jun. 21, 2016 (CN) ..... 2016 2 0633958 U

(51) Int. Cl.

| | |
|---|---|
| ***F21V 14/06*** | (2006.01) |
| ***F21V 29/70*** | (2015.01) |
| ***F21V 3/06*** | (2018.01) |
| ***F21V 5/04*** | (2006.01) |
| ***F21V 7/00*** | (2006.01) |
| ***F21V 21/30*** | (2006.01) |
| ***F21V 17/16*** | (2006.01) |

(Continued)

(52) U.S. Cl.

CPC ..... *F21V 14/06* (2013.01); *F21V 3/061* (2018.02); *F21V 5/04* (2013.01); *F21V 7/00* (2013.01); *F21V 17/164* (2013.01); *F21V 21/30* (2013.01); *F21V 29/70* (2015.01); *F21V 23/006* (2013.01); *F21Y 2115/10* (2016.08)

(58) Field of Classification Search

CPC ..... F21V 14/06; F21V 21/30; F21V 29/70; F21V 7/00; F21V 3/061; F21Y 2115/10

See application file for complete search history.

(56) References Cited

U.S. PATENT DOCUMENTS 9,784,440 B2 * 10/2017 Erdener ..... F21V 21/26
2014/0049967 A1 * 2/2014 Zhou ..... F21V 14/06 362/287

(Continued)

FOREIGN PATENT DOCUMENTS

JP H03-124402 A 12/1991
JP 2012243421 A 12/2012

(Continued)

*Primary Examiner* — Peggy Neils

(74) *Attorney, Agent, or Firm* — Muncy, Geissler, Olds & Lowe, P.C.

(57) ABSTRACT

A zoom lamp includes a lamp body, a light emitting component, a movable ring, a lens, and a rotation ring. The lamp body defines a receiving groove. The movable ring includes a plurality of guiding posts protruding from an outer wall thereof and a plurality of resilient members. The lens is fixed to the movable ring. An external wall of the rotation ring is provided with a latching hook, the rotation ring defines a plurality of inclined grooves. When the rotating ring rotates, the guiding post is guided by the inclined groove to slide, thereby driving the lens to move adjacent to or away from the light emitting component.

11 Claims, 5 Drawing Sheets

(51) Int. Cl.
*F21Y 115/10* (2016.01)
*F21V 23/00* (2015.01)

(56) References Cited

U.S. PATENT DOCUMENTS

| | | | | |
|---|---|---|---|---|
| 2015/0029707 | A1* | 1/2015 | Cheng | F21L 4/027 362/187 |
| 2017/0211759 | A1* | 7/2017 | Qiu | F21L 4/02 |
| 2017/0307196 | A1* | 10/2017 | Matsui | F21V 29/763 |

FOREIGN PATENT DOCUMENTS

| | | | |
|---|---|---|---|
| JP | 2016024854 | A | 2/2016 |
| WO | WO 2006/129570 | A1 | 1/2009 |

* cited by examiner

ZOOM LAMP

FIELD OF THE INVENTION

The present disclosure relates to a technical field of lightings, and more particularly relates to a zoom lamp.

BACKGROUND OF THE INVENTION

Traditionally, a light emitting orientation is generally immobile. When the light emitting orientation is required to be changed, the lamp should be replaced. During the replacement process, the configured angle should be detected one by one, the operation is troublesome, and the cost of material, logistics, and the construction is increased at the same time.

SUMMARY

Therefore, it is necessary to provide a zoom lamp which can perform an infinite regulation to a light emitting orientation according to an actual requirement.

A zoom lamp includes: a lamp body defining a receiving groove, wherein an inner wall of the lamp body defines an annular latching groove coaxial with the receiving groove and a plurality of sliding grooves extending along an axial direction of the lamp body; a light emitting component received in the receiving groove; a movable ring including a plurality of guiding posts protruding from an outer wall thereof and a plurality of resilient members connected to the plurality of guiding posts correspondingly, wherein the guiding post extends along an axial direction of the movable ring to engage the sliding grove which is slidably positioned in the lamb body, the resilient member is configured to provide a reversed resistance which is opposite to a sliding direction of the guiding post for the guiding post; a lens fixed to the movable ring; wherein an external wall of the rotation ring is provided with a latching hook sliding along the annular latching groove, the plurality of guiding posts slide in the plurality of inclined grooves correspondingly and resist bottoms of the plurality of inclined grooves; wherein when the rotating ring rotates, the guiding post is guided in the inclined groove to slide along the sliding groove, thereby driving the lens to move adjacent to or away from the light emitting component.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

Embodiments of the invention are described more fully hereinafter with reference to the accompanying drawings, in which preferred embodiments of the invention are shown. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
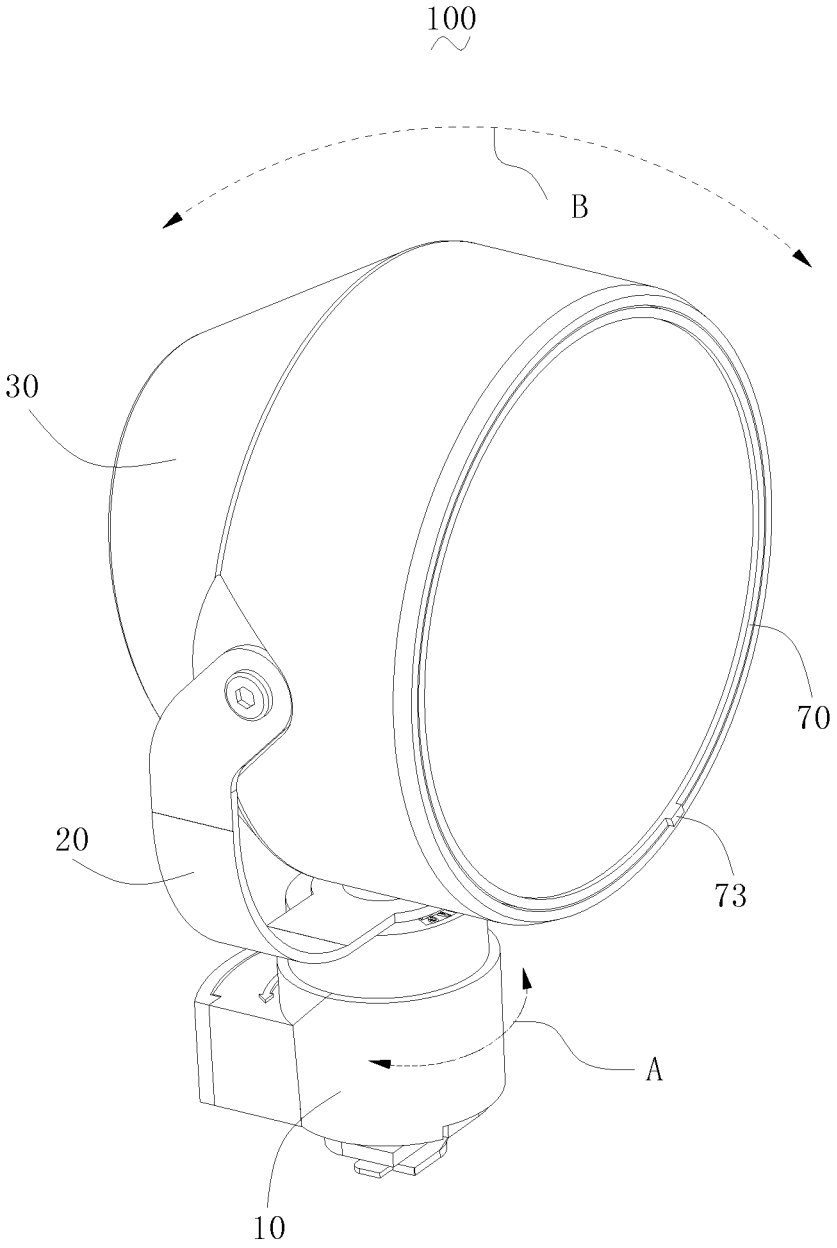
FIG. 1 is a perspective view of a zoom lamp according to an embodiment.
Figure 2:
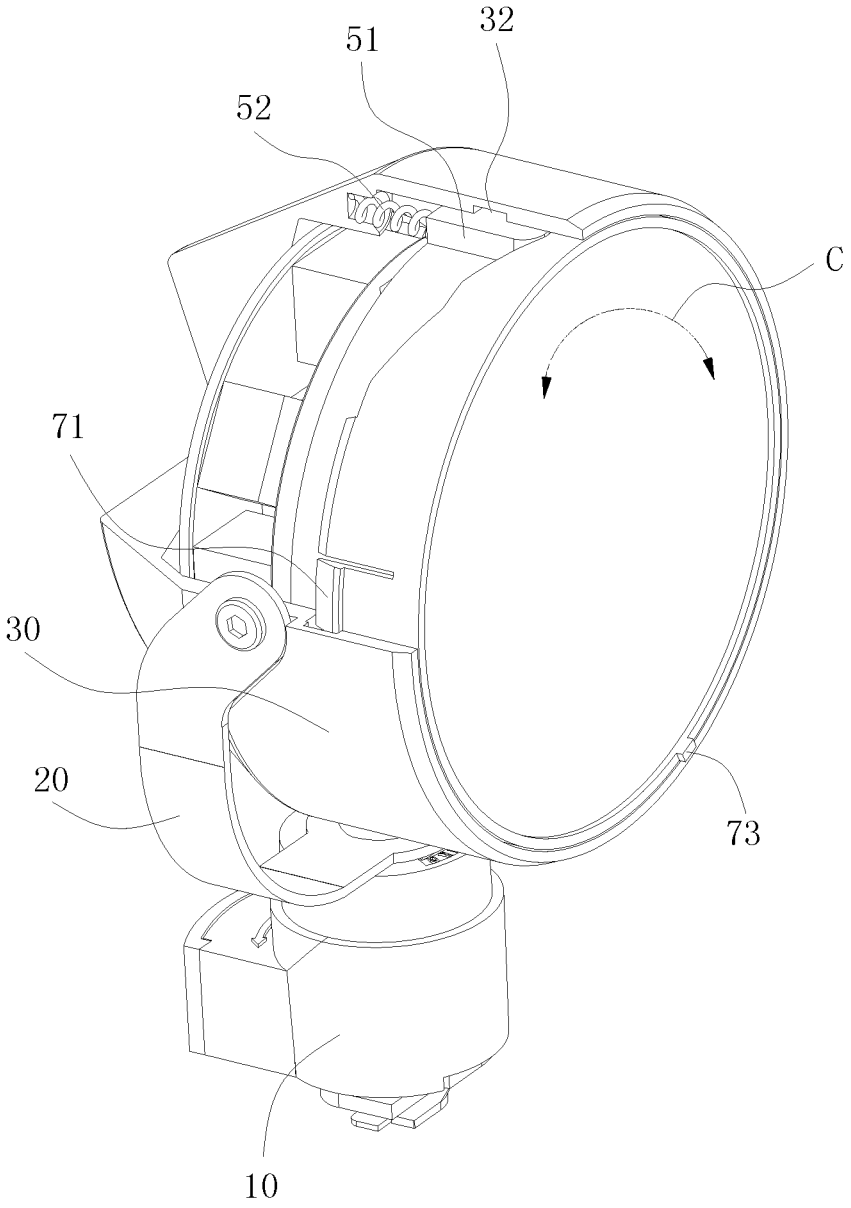
FIG. 2 is similar to FIG. 1 with a part thereof being removed.
Figure 3:
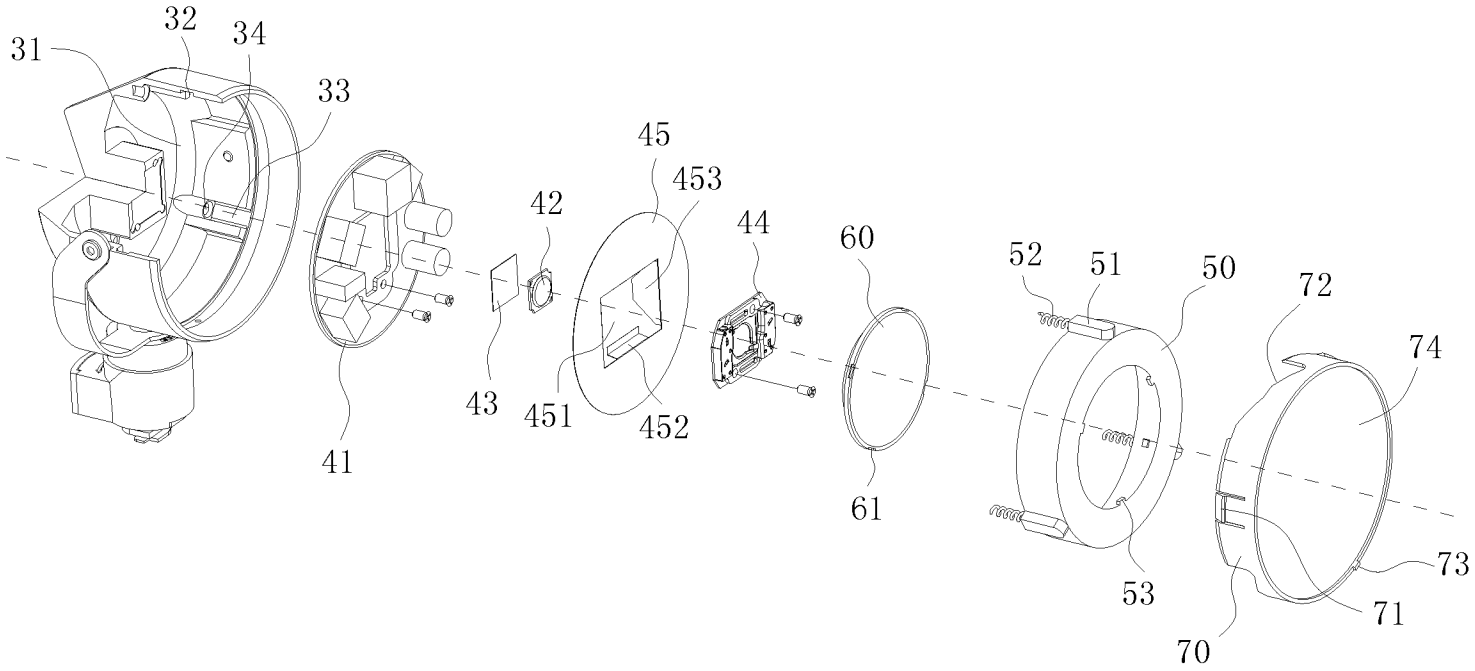
FIG. 3 is an exploded view of the zoom lamp of FIG. 2.
Figure 4:
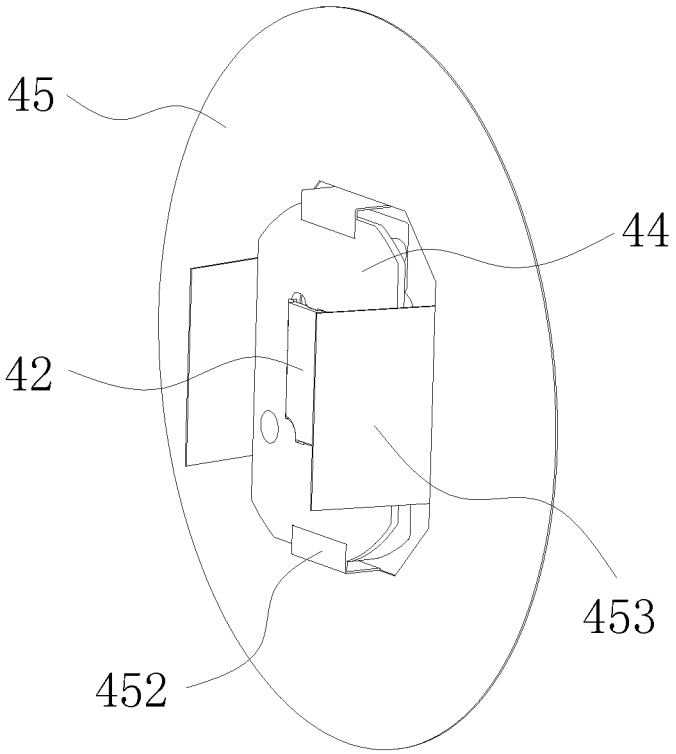
FIG. 4 is an assembled view of an LED lamp, a support member, and a reflector of FIG. 3.
Figure 5:
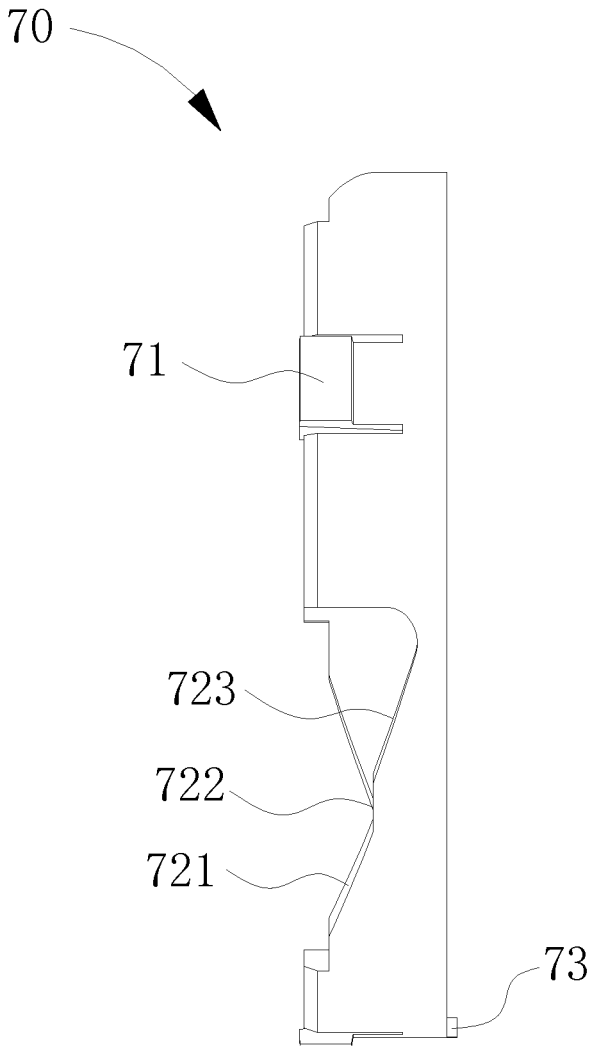
FIG. 5 is a side view of a rotation ring of FIG. 3.

As shown in FIG. 1 through FIG. 5, a zoom lamp 100 according to an embodiment includes a base 10, an arc bracket 20, a lamp body 30, a light emitting component, a movable ring 50, a lens 60 and a rotation ring 70. A middle of the arc bracket 20 is rotatably positioned on the base 10, the lamp body 30 is respectively pivoted to opposite ends of the arc bracket 20, such that the arc bracket 20 is rotatably relative to the base 10 along A direction, the lamp body 30 is rotatably relative to the arc shape 20 along B direction, thus a flexible regulation of the zoom lamp 100 is realized.

The lamp body 30 defines a receiving groove 31 in a cylindrical shape, the light emitting component is received in the receiving groove 31. Specifically in the embodiment, the light emitting component includes a PCB 41 located in a bottom of the receiving groove 31, an LED lamp 42 electrically connected to the PCB 41, a heat dissipation sheet 43 in contact with the LED lamp 42, a support member 44, and a reflector 45. The LED lamp 42 is positioned on the support member 44, a fixation assembly of the LED lamp 42 is realized. A middle of the reflector 45 defines a rectangular through hole 451, opposite edges of the through hole 451 are respectively provided with a L-shaped bending edge 452, the support member 44 is embedded in the through hole 451 and is latched between the two L-shaped bending edges 452, such that the support member 44 is fixedly secured. Further, the other two edges of the through hole 451 are respectively provided with a fender 453. In one embodiment, the L-shaped bending edge 452, the fender 453 and the reflector 45 are integrally formed.

An inner wall of the lamp body 30 defines an annular latching groove 32 coaxial with the receiving groove 31 and a plurality of sliding grooves 33 which are uniformly distributed. The sliding groove 33 extends along an axial direction of the inner wall of the lamp body 30. In the embodiment, the sliding groove 33 is perpendicular to the annular latching groove 32 and is in communication with the annular latching groove 32. The plurality of sliding grooves 33 are formed between two protrusions which are oppositely positioned. The movable ring 50 includes a plurality of guiding posts 51 protruding from an outer wall and a plurality of resilient members 52 connected to the plurality of guiding posts 51 correspondingly. The plurality of guiding posts 51 are positioned the plurality of sliding grooves 33 correspondingly. Further, the guiding post 51 can slide in the sliding groove 33 along the axial direction of the lamp body 30. The resilient member 52 is configured to provide a reversed resistance opposite to a sliding direction of the guiding post 51. In the embodiment, a number of the sliding grooves 33 and a number of the guiding posts 51 each is three. It should be noted that, the number and distribution mode of the sliding grooves 33 can be configured according to an actual application, and are not limited to three and an uniformly distribution mode.

Specifically in the embodiment, the resilient member 52 is a spring, the inner wall of the lamp body 30 defines a positioning hole 34 facing the sliding groove 33. A first end of the spring is embedded in the guiding post 51, a second end of the spring extends into the positioning hole 34, a stability of the spring in the compression and expanding process. In other embodiments, the resilient member 52 can also be an elastic strip.

The lens 60 is fixed in the movable ring 50, causing the movable ring 50 to move reciprocally along a central axis of the receiving groove 31. The lens 60 moves synchronously with the movable ring 50. In the way how to realize a fixed connection between the lens 60 and the movable ring 50, in the embodiment, an inner wall of the movable ring 50 is provided with a plurality of protruding blocks 53. The lens 60 defines a plurality of limiting grooves 61 at a periphery thereof. The plurality of protruding blocks 53 are latched in the plurality of limiting grooves 61, thereby achieving a fixation of the lens 60, avoiding the lens 60 from rotating and disengaging from the movable ring 50.

An external wall of the rotation ring 70 is provided with a latching hook 71 sliding along the annular latching groove 32 protruding outwardly. In the process of rotating the rotation ring 70, it is can be achieved that the rotation ring 70 merely rotates along a circumference direction of the receiving groove 31 relative to the lamp body 30, and it can be avoided that the rotation ring 70 rotates along an axial direction of the receiving groove 31 relative to the lamp body 30. In order to facilitate to operating the rotation ring 70 to rotate, the rotation ring 70 is provided an operation rod 73 protruding outwardly. In order to avoid containments to enter the lamp body 30, the rotation ring 70 is provided with a light transmissive glass 74 therein.

In order to facilitate the rotation ring 70 driving the movable ring 50 to move reciprocally along the direction of the central axis of the receiving groove 31 during the process that the rotation ring 70 rotates in a forward or in a reverse of a C direction, the rotation ring 70 defines a plurality of inclined grooves 72, the guiding post 51 is slidably resists the inclined groove 72. In the embodiment, each inclined groove 72 is provided with a first bevel edge 72, a flat edge 722, and a second bevel edge 733 successively connected to each other. The first bevel edge 72, the flat edge 722, and the second bevel edge 733 engage the guiding post 51. The first bevel edge 72 and the second bevel edge 733 are inclined relative to the light transmissive glass 74, and the flat edge 722 is parallel to the light transmissive glass 74. An inclined direction of the first bevel edge 72 is substantially parallel to an inclined direction of the second bevel edge 733.

When the guiding post 51 resists the flat edge 722, an automatic rotation of the rotation 70 can be effectively avoided. During the process that the guiding post 51 gradually slides from the flat edge 722 to the first bevel edge 721, the lens 60 is driven to gradually move adjacent to the light emitting component. During the process that the guiding post 51 gradually slides from the flat edge 722 to the second bevel edge 733, the lens 60 is driven to gradually move away from the light emitting component, thereby achieving an infinite regulation of the light emitting orientation according to an actual requirement.

In aforementioned zoom lamp 100, by virtue of rotating the rotation ring 70, causing the rotation ring 70 to move along a circumference direction of the receiving groove 31 relative to the lamp body 30, under function of an engagement of the inclined groove 72, the guiding post 51, and the resilient member 52, the lens 60 which is fixedly located in the movable ring is driven to gradually move adjacent to or away from the light emitting component, an infinite regulation of the light emitting orientation according to an actual requirement.

While the disclosed subject matter has been described with reference to illustrative embodiments, this description is not intended to be construed in a limiting sense. Various modifications of the illustrative embodiments, as well as other embodiments of the subject matter, which are apparent to persons skilled in the art to which the disclosed subject matter pertains are deemed to lie within the scope of the disclosed subject matter.

What is claimed is:

1. A zoom lamp, comprising:

a lamp body defining a receiving groove, wherein an inner wall of the lamp body defines an annular latching groove coaxial with the receiving groove and a plurality of sliding grooves extending along an axial direction of the lamp body;

a light emitting component received in the receiving groove;

a movable ring comprising a plurality of guiding posts protruding from an outer wall thereof and a plurality of resilient members connected to the plurality of guiding posts correspondingly, wherein the guiding post extends along an axial direction of the movable ring to engage the sliding grove which is slidably positioned in the lamp body, the resilient member is configured to provide a reversed resistance which is opposite to a sliding direction of the guiding post;

a lens fixed to the movable ring;

a rotation ring, wherein an external wall of the rotation ring is provided with a latching hook sliding along the annular latching groove, the rotation ring defines a plurality of inclined grooves, the plurality of guiding posts slide in the plurality of inclined grooves correspondingly and abut bottoms of the plurality of inclined grooves;

wherein when the rotating ring rotates, the guiding post is guided in the inclined groove to slide along the sliding groove, thereby driving the lens to move adjacent to or away from the light emitting component.

2. The zoom lamp according to claim 1, wherein the inner wall of the lamp body defines a positioning hole facing the sliding groove, a first end of the resilient member is embedded in the guiding post, a second end of the resilient member extends into the positioning hole.

3. The zoom lamp according to claim 1, wherein the light emitting component comprises a PCB (printed circuit board), an LED (light-emitting diode) lamp electrically connected to the PCB, and a support member, the LED lamp is positioned on the support member.

4. The zoom lamp according to claim 3, wherein the light emitting component further comprises a reflector, a middle portion of the reflector defines a through hole, an edge of the through hole is provide with a L-shaped bending edge, the support member is embedded in the through hole and is latched on the L-shaped bending edge.

5. The zoom lamp according to claim 3, wherein the light emitting component further comprises a heat dissipation sheet in contact with the LED lamp.

6. The zoom lamp according to claim 1, wherein an inner wall of the movable ring is provided with a plurality of protruding blocks, the lens defines a plurality of limiting grooves at a periphery thereof, the plurality of protruding blocks are latched in the plurality of limiting grooves.

7. The zoom lamp according to claim 1, wherein the rotation ring is provided with a light transmissive glass therein.

8. The zoom lamp according to claim 7, wherein the inclined groove has a first bevel edge, a flat edge, and a second bevel edge successively connected to each other, which are configured to engage the guiding post.

9. The zoom lamp according to claim 8, wherein the first bevel edge and the second bevel edge are inclined relative to the light transmissive glass, and the flat edge is parallel to the light transmissive glass.

10. The zoom lamp according to claim 9, wherein an inclined direction of the first bevel edge is substantially parallel to an inclined direction of the second bevel edge.

11. The zoom lamp according to claim 1, further comprising a base and a bracket rotatably positioned on the base, wherein the lamp body is rotatably connected to the bracket.

* * * * *